US007993490B2

(12) United States Patent
Runge et al.

(10) Patent No.: US 7,993,490 B2
(45) Date of Patent: Aug. 9, 2011

(54) METHOD FOR APPLYING CHEMICAL ADDITIVES TO PULP DURING THE PULP PROCESSING AND PRODUCTS MADE BY SAID METHOD

(75) Inventors: Troy Michael Runge, Neenah, WI (US); Louise Cynthia Ellis Coe, Appleton, WI (US); Mike Thomas Goulet, Neenah, WI (US); Ricardo Toru Nishihata, Jacarei (BR); Vera Maria Sacon, São Paulo (BR)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 12/796,936

(22) Filed: Jun. 9, 2010

(65) Prior Publication Data

US 2010/0243187 A1 Sep. 30, 2010

Related U.S. Application Data

(62) Division of application No. 09/800,645, filed on Mar. 7, 2001, now Pat. No. 7,749,356.

(51) Int. Cl.
*D21F 11/00* (2006.01)

(52) U.S. Cl. ..... 162/158

(58) Field of Classification Search ..... 162/158, 162/109, 111, 112, 113, 164.3, 164.8, 168.1, 162/179, 9, 173
See application file for complete search history.

(56) References Cited

U.S. PATENT DOCUMENTS

| | | | | |
|---|---|---|---|---|
| 1,812,832 | A | | 6/1931 | Rafton |
| 2,061,935 | A | | 11/1936 | Delcroix |
| 2,110,032 | A | | 3/1938 | Williams |
| 2,606,115 | A | | 8/1952 | Nuessle et al. |
| 2,799,241 | A | | 7/1957 | Wurster |
| 3,014,832 | A | | 12/1961 | Donnelly |
| 3,056,714 | A | | 10/1962 | Feigley, Jr. et al. |
| 3,089,824 | A | | 5/1963 | Wurster |
| 3,117,027 | A | | 1/1964 | Lindlof et al. |
| 3,196,827 | A | | 7/1965 | Wurster et al. |
| 3,207,824 | A | | 9/1965 | Wurster et al. |
| 3,241,520 | A | | 3/1966 | Wurster et al. |
| 3,253,944 | A | | 5/1966 | Wurster |
| 3,395,708 | A | | 8/1968 | Hervey et al. |
| 3,554,862 | A | | 1/1971 | Hervey et al. |
| 3,554,863 | A | | 1/1971 | Hervey et al. |
| 3,556,931 | A | * | 1/1971 | Champaigne ..... 162/158 |
| 3,677,886 | A | | 7/1972 | Lars-Henrik Forssblad et al. |
| 3,756,913 | A | | 9/1973 | Wodka |
| 3,770,575 | A | | 11/1973 | Ball |
| 3,819,470 | A | | 6/1974 | Shaw et al. |
| 3,821,073 | A | | 6/1974 | Eriksson |
| 3,994,771 | A | | 11/1976 | Morgan, Jr. et al. |
| 4,014,736 | A | | 3/1977 | Sexton |
| 4,046,621 | A | | 9/1977 | Sexton |
| 4,049,493 | A | | 9/1977 | Lare |
| 4,081,319 | A | | 3/1978 | Conway |
| 4,093,506 | A | | 6/1978 | Richter |
| 4,128,692 | A | | 12/1978 | Reid |
| 4,144,122 | A | | 3/1979 | Emanuelsson et al. |
| 4,198,267 | A | | 4/1980 | Flaherty |
| 4,302,488 | A | | 11/1981 | Lowi, Jr. |
| 4,310,384 | A | | 1/1982 | Meredith et al. |
| 4,326,000 | A | | 4/1982 | Roberts, Jr. |
| 4,383,834 | A | | 5/1983 | Degen et al. |
| 4,431,481 | A | | 2/1984 | Drach et al. |
| 4,432,833 | A | | 2/1984 | Breese |
| 4,448,638 | A | | 5/1984 | Klowak |
| 4,481,076 | A | | 11/1984 | Herrick |
| 4,481,077 | A | | 11/1984 | Herrick |
| 4,482,429 | A | | 11/1984 | Klowak |
| 4,506,081 | A | | 3/1985 | Fenyes et al. |
| 4,508,860 | A | | 4/1985 | Hawes |
| 4,510,020 | A | | 4/1985 | Green et al. |
| 4,623,588 | A | | 11/1986 | Nuwayser et al. |
| 4,624,743 | A | | 11/1986 | Gess |
| 4,675,140 | A | | 6/1987 | Sparks et al. |
| 4,720,383 | A | | 1/1988 | Drach et al. |

(Continued)

FOREIGN PATENT DOCUMENTS

| | | | |
|---|---|---|---|
| EP | 0 109 282 | A2 | 5/1984 |
| EP | 0 116 512 | A1 | 8/1984 |
| EP | 0 132 128 | A1 | 1/1985 |
| EP | 0 335 576 | A2 | 10/1989 |
| EP | 0 226 408 | B1 | 7/1991 |

(Continued)

OTHER PUBLICATIONS

Saint-Cyr, Karine, Adsorption Kinetitics of Dyes and Yellowing Inhibitors on Pulp Fibers, Master of Engineering Thesis, McGill University, Montreal, Canada, Jun. 1999.*

Haylock, E.W., Editor, Chapter 5, "Preparation of Pulp for the Paper Machine," Chapter 6, "The Fourdrinier Paper Machine," and Chapter 7, "Special Paper Machines. Board Manufacture," *Paper: Its Making, Merchanting and Usage*, The National Association of Paper Merchants, London, 1975, pp. 49-101.

(Continued)

*Primary Examiner* — Mark Halpern
(74) *Attorney, Agent, or Firm* — Michael J. Sullivan

(57) ABSTRACT

Pulp fibers can be treated with chemical additives with a minimal amount of unretained chemical additives present later in the process water. The present invention is a method for preparing chemically treated pulp fiber. A fiber slurry is created comprising process water and pulp fibers. The fiber slurry is transported to a web-forming apparatus of a pulp sheet machine thereby forming a wet fibrous web. The wet fibrous web is dried to a predetermined consistency thereby forming a dried fibrous web. The dried fibrous web is treated with a chemical additive thereby forming a chemically treated dried fibrous web. The dried fibrous web contains chemically treated pulp fibers. The chemically treated pulp fibers retain from between about 10 to about 100 percent of the applied amount of the chemical additive when the chemically treated pulp fibers are redispersed in water.

22 Claims, 5 Drawing Sheets

U.S. PATENT DOCUMENTS

| | | | | |
|---|---|---|---|---|
| 4,808,266 | A | | 2/1989 | Faurie |
| 4,853,086 | A | | 8/1989 | Graef |
| 4,908,101 | A | | 3/1990 | Frisk et al. |
| 4,969,976 | A | | 11/1990 | Reed |
| 4,986,882 | A | | 1/1991 | Mackey et al. |
| 5,035,772 | A | | 7/1991 | Agnemo et al. |
| 5,073,234 | A | | 12/1991 | Mollett et al. |
| 5,087,324 | A | | 2/1992 | Awofeso et al. |
| 5,096,539 | A | | 3/1992 | Allan |
| 5,102,500 | A | | 4/1992 | Darlington |
| 5,127,994 | A | | 7/1992 | Johansson |
| 5,137,600 | A | | 8/1992 | Barnes et al. |
| 5,139,671 | A | | 8/1992 | Henricson et al. |
| 5,164,046 | A | | 11/1992 | Ampulski et al. |
| 5,221,434 | A | | 6/1993 | Henricson |
| 5,223,090 | A | | 6/1993 | Klungness et al. |
| 5,238,501 | A | | 8/1993 | Kappel et al. |
| 5,254,168 | A | | 10/1993 | Littman et al. |
| 5,296,024 | A | | 3/1994 | Hutcheson |
| 5,348,620 | A | | 9/1994 | Hermans et al. |
| 5,389,204 | A | | 2/1995 | Ampulski |
| 5,393,334 | A | | 2/1995 | Hutcheson |
| 5,397,435 | A | | 3/1995 | Ostendorf et al. |
| 5,399,241 | A | | 3/1995 | Oriaran et al. |
| 5,405,499 | A | | 4/1995 | Vinson |
| 5,405,501 | A | | 4/1995 | Phan et al. |
| 5,437,766 | A | | 8/1995 | Van Phan et al. |
| 5,443,899 | A | | 8/1995 | Barcus et al. |
| 5,494,554 | A | | 2/1996 | Edwards et al. |
| 5,501,768 | A | | 3/1996 | Hermans et al. |
| 5,547,541 | A | * | 8/1996 | Hansen et al. ..... 162/12 |
| 5,552,020 | A | | 9/1996 | Smith et al. |
| 5,591,306 | A | | 1/1997 | Kaun |
| 5,603,804 | A | | 2/1997 | Hansen et al. |
| 5,607,551 | A | | 3/1997 | Farrington, Jr. et al. |
| 5,624,532 | A | | 4/1997 | Trokhan et al. |
| 5,625,015 | A | | 4/1997 | Brinen et al. |
| 5,649,915 | A | | 7/1997 | Chauvette et al. |
| 5,656,132 | A | | 8/1997 | Farrington, Jr. et al. |
| 5,667,636 | A | | 9/1997 | Engel et al. |
| 5,672,248 | A | | 9/1997 | Wendt et al. |
| 5,679,218 | A | | 10/1997 | Vinson et al. |
| 5,695,607 | A | | 12/1997 | Oriaran et al. |
| 5,725,736 | A | | 3/1998 | Schroeder et al. |
| 5,730,839 | A | | 3/1998 | Wendt et al. |
| 5,753,079 | A | | 5/1998 | Jenny et al. |
| 5,759,349 | A | | 6/1998 | Foster et al. |
| 5,772,845 | A | | 6/1998 | Farrington, Jr. et al. |
| 5,785,813 | A | | 7/1998 | Smith et al. |
| 5,788,815 | A | | 8/1998 | Norell et al. |
| 5,830,320 | A | | 11/1998 | Park et al. |
| 5,853,539 | A | | 12/1998 | Smith et al. |
| 5,928,470 | A | | 7/1999 | Shannon |
| 5,958,180 | A | | 9/1999 | Hubbe et al. |
| 6,027,611 | A | | 2/2000 | McFarland et al. |
| 6,054,020 | A | | 4/2000 | Goulet et al. |
| 6,074,524 | A | | 6/2000 | Wu et al. |
| 6,126,784 | A | | 10/2000 | Ficke et al. |
| 6,136,147 | A | | 10/2000 | Edwards et al. |
| 6,162,329 | A | | 12/2000 | Vinson et al. |
| 6,171,441 | B1 | | 1/2001 | Phillips et al. |
| 6,245,874 | B1 | | 6/2001 | Staib et al. |
| 6,322,665 | B1 | | 11/2001 | Sun et al. |
| 6,332,952 | B1 | | 12/2001 | Hsu et al. |
| 6,344,109 | B1 | | 2/2002 | Gross |
| 6,379,498 | B1 | | 4/2002 | Burns et al. |
| 6,383,337 | B1 | | 5/2002 | Meinecke et al. |
| 6,423,183 | B1 | | 7/2002 | Goulet et al. |
| 6,582,560 | B2 | | 6/2003 | Runge et al. |
| 7,749,356 | B2 | * | 7/2010 | Runge et al. ..... 162/158 |
| 2002/0088582 | A1 | | 7/2002 | Burns et al. |
| 2002/0139500 | A1 | | 10/2002 | Runge et al. |
| 2003/0159786 | A1 | | 8/2003 | Runge et al. |

FOREIGN PATENT DOCUMENTS

| | | | | |
|---|---|---|---|---|
| EP | 0 613 979 | A1 | | 9/1994 |
| EP | 0 643 164 | B1 | | 11/1997 |
| EP | 0 851 062 | A2 | | 7/1998 |
| EP | 0 772 716 | B1 | | 3/2002 |
| GB | 1 407 134 | A | | 9/1975 |
| JP | 07-189170 | A | | 7/1995 |
| JP | 07-189171 | A | | 7/1995 |
| WO | WO 89/02952 | | | 4/1989 |
| WO | WO 90/12146 | | | 10/1990 |
| WO | WO 94/19534 | | | 9/1994 |
| WO | WO 95/01479 | | | 1/1995 |
| WO | WO 95/20066 | | | 7/1995 |
| WO | WO 96/06223 | | | 2/1996 |
| WO | WO 97/13026 | A1 | | 4/1997 |
| WO | WO 97/31153 | A1 | | 8/1997 |
| WO | WO 98/09021 | A1 | | 3/1998 |
| WO | WO 98/16570 | A1 | | 4/1998 |
| WO | WO 98/17856 | A1 | | 4/1998 |
| WO | WO 98/17864 | A1 | | 4/1998 |
| WO | WO 98/23814 | A1 | | 6/1998 |
| WO | WO 98/35095 | A1 | | 8/1998 |
| WO | WO 99/31312 | A1 | | 6/1999 |
| WO | WO 99/34057 | A1 | | 7/1999 |
| WO | 00/66835 | | * | 11/2000 |

OTHER PUBLICATIONS

Janes, R.L. "The Chemistry of Wood and Fibers," *The Pulping of Wood*, Second Edition, vol. 1, McGraw-Hill Book Company, 1969, pp. 33-72.

Smook, Gary A., Editor, "Non-Fibrous Additives to Papermaking Stock," Chapter 15, *Handbook for Pulp & Paper Technologists*, Second Edition, Angus Wilde Publications, Bellingham, WA, 1992, pp. 220, 225-226.

* cited by examiner

METHOD FOR APPLYING CHEMICAL ADDITIVES TO PULP DURING THE PULP PROCESSING AND PRODUCTS MADE BY SAID METHOD

This application is a divisional of U.S. application Ser. No. 09/800,645, now U.S. Pat. No. 7,749,356, filed Mar. 7, 2001.

BACKGROUND OF THE INVENTION

In the manufacture of paper products, it is often desirable to enhance physical and/or optical properties by the addition of chemical additives. Typically, chemical additives such as softeners, colorants, brighteners, strength agents, etc. are added to the fiber slurry upstream of the headbox in a paper making machine during the manufacturing or converting stages of production to impart certain attributes to the finished product. These chemical additives are usually mixed in a stock chest or stock line where the fiber slurry has a fiber consistency of from between about 0.15 to about 5 percent or spraying the wet or dry paper or tissue during production.

One disadvantage of adding a chemical additive at each paper machine is that the manufacturer has to install equipment on each paper machine to accomplish the chemical additive addition. This, in many cases, is a costly proposition. In addition, the uniformity of the finished product coming off of each paper machine may vary depending upon how the chemical additive was added, variations in chemical additive uniformity and concentrations, the exact point of chemical additive introduction, water chemistry differences among the paper machines as well as personnel and operational differences of each paper machine.

Another difficulty associated with wet end chemical additive addition is that the water soluble or water dispersible chemical additives are suspended in water and are not completely adsorbed or retained onto the fibers prior to formation of the wet mat. To improve adsorption of wet end chemical additives, the chemical additives are often modified with functional groups to impart an electrical charge when in water. The electrokinetic attraction between charged chemical additives and the anionically charged fiber surfaces aids in the deposition and retention of chemical additives onto the fibers. Nevertheless, the amount of the chemical additive that can be adsorbed or retained in the paper machine wet end generally follows an adsorption curve exhibiting diminishing incremental adsorption with increasing concentration, similar to that described by Langmuir. As a result, the adsorption of water soluble or water dispersible chemical additives may be significantly less than 100 percent, particularly when trying to achieve high chemical additive loading levels.

Consequently, at any chemical addition level, and particularly at high addition levels, a fraction of the chemical additive is retained on the fiber surface. The remaining fraction of the chemical additive remains dissolved or dispersed in the suspending water phase. These unadsorbed or unretained chemical additives can cause a number of problems in the papermaking process. The exact nature of the chemical additive will determine the specific problems that may arise, but a partial list of problems that may result from unadsorbed or unretained chemical additives includes: foam, deposits, contamination of other fiber streams, poor fiber retention on the machine, compromised chemical layer purity in multi-layer products, dissolved solids build-up in the water system, interactions with other process chemicals, felt or fabric plugging, excessive adhesion or release on dryer surfaces, physical property variability in the finished product.

Therefore, what is lacking and needed in the art is a method for applying chemical additives onto pulp fiber surfaces in the initial or primary pulp processing, providing more consistent chemical additive additions to the pulp fiber and a reduction or elimination of unretained chemical additives in the process water on a paper machine. The method minimizes the associated manufacturing and finished product quality problems that would otherwise occur with conventional wet end chemical addition at the paper machine.

SUMMARY OF THE INVENTION

It has now been discovered that chemical additives can be applied to pulp fibers at high and/or consistent levels with at most a minimal amount of unretained chemical additives present in the papermaking process water after the treated pulp fiber has been redispersed in water. This is accomplished by treating a fibrous web prior to the finishing operation at a pulp mill with a chemical additive, completing the finishing operation, redispersing the finished pulp at the paper mill and using the finished pulp in the production of a paper product.

Hence in one aspect, the invention resides in a method for applying chemical additives to the pulp fibers. The method comprises creating a fiber slurry comprising water and pulp fibers. The fiber slurry is formed into a wet fibrous web using a web forming apparatus. The wet fibrous web is dewatered to a predetermined consistency, thereby forming a dewatered fibrous web. A chemical additive is applied to the dewatered fibrous web, thereby forming a chemically treated dewatered fibrous web. In other embodiments of the present invention, the process may include further dewatering of the dewatered fibrous web, thereby forming a crumb-form before or after the application of the chemical additive. The chemically treated dewatered fibrous web contains chemically treated pulp fibers that have retained from between about 10 to about 100 percent of the applied amount of the chemical additive when the chemically treated pulp fibers are redispersed in water. The chemically treated pulp fiber is then used in a separate process to produce paper product.

In another aspect, the invention resides in a method for applying chemical additives to the pulp fibers. The method comprises creating a fiber slurry comprising water and pulp fibers. The fiber slurry is formed into a wet fibrous web using a web forming apparatus. The wet fibrous web is dewatered to a predetermined consistency, thereby forming a dewatered fibrous web. In other embodiments of the present invention, the process may include further dewatering of the dewatered fibrous web, thereby forming a crumb-form. The dewatered fibrous web is dried to a predetermined consistency, thereby forming a dried fibrous web. A chemical additive is applied to the dried fibrous web, thereby forming a chemically treated dried fibrous web. The chemically treated dried fibrous web contains chemically treated pulp fibers that have retained from between about 10 to about 100 percent of the applied amount of the chemical additive when the chemically treated pulp fibers are redispersed in water. The chemically treated pulp fiber is then used in a separate process to produce paper product.

According to another embodiment of the present invention is a method for applying a chemical additive to the pulp fiber during the pulp processing stage. During the pulp processing stage, upstream of a paper machine, one can obtain chemically treated pulp fiber. Furthermore, the chemically treated pulp fiber can be transported to several different paper machines that may be located at various sites, and the quality of the finished product from each paper machine will be more consistent. Also, by chemically treating the pulp fiber before the pulp fiber is made available for use on multiple paper machines or multiple runs on a paper machine, the need to install equipment at each paper machine for the chemical additive addition can be eliminated.

The term "unretained" refers to any portion of the chemical additive that is not retained by the pulp fiber and thus remains suspended in the process water. The term "web-forming apparatus" includes fourdrinier former, twin wire former, cylinder machine, press former, crescent former, and the like used in the pulp stage known to those skilled in the art. The term "water" refers to water or a solution containing water and other treatment additives desired in the papermaking process. The term "chemical additive" refers to a single treatment compound or to a mixture of treatment compounds. It is also understood that a chemical additive used in the present invention may be an adsorbable chemical additive.

The consistency of the dried fibrous web is from about 65 to about 100 percent. In other embodiments, the consistency of the dried fibrous web is from about 80 to about 100 percent or from about 85 to about 95 percent. The consistency of the dewatered fibrous web is from about 20 to about 65 percent. In other embodiments, the consistency of the dewatered fibrous web is from about 40 to about 65 percent or from about 50 to about 65 percent. The consistency of the crumb form is from about 30 to about 85 percent. In other embodiments, the consistency of the crumb form is from about 30 to about 60 percent or from about 30 to about 45 percent.

The present method allows for the production of pulp fibers that are useful for making paper products. One aspect of the present invention is a uniform supply of chemically treated pulp fiber, replacing the need for costly and variable chemical treatments at one or more paper machines.

In another embodiment, the chemically treated pulp fiber slurry of the present invention comprises process water and having an applied chemical additive retained by the pulp fibers. The amount of chemical additive retained by the chemically treated pulp fibers is about 0.1 kilogram per metric ton or greater. In particularly desirable embodiments, the amount of retained chemical additive is about 0.5 kg/metric ton or greater, particularly about 1 kg/metric ton or greater, and more particularly about 2 kg/metric ton or greater. Once the chemically treated pulp fibers are redispersed at the paper machine, the amount of unretained chemical additive in the process water phase is between 0 and about 50 percent, particularly between 0 and about 30 percent, and more particularly between 0 and about 10 percent, of the amount of chemical additive retained by the pulp fibers.

According to one embodiment of the present invention, the method for adding a chemical additive to pulp fiber comprises creating a fiber slurry. The fiber slurry comprises water and pulp fibers. The fiber slurry is passed to a web-forming apparatus of a pulp sheet machine where a wet fibrous web is formed from the fiber slurry. The wet fibrous web is dewatered to a predetermined consistency, thereby forming a dewatered fibrous web. The dewatered fibrous web is dried to a predetermined consistency, thereby forming a dried fibrous web. A chemical additive is then applied to the dried fibrous web. The resulting chemically treated dried fibrous web contains chemically treated pulp fibers that have retained from between about 10 to about 100 percent of the applied amount of the chemical additive when the chemically treated pulp fibers are redispersed in water. The chemically treated dried fibrous web may be transported to a paper machine. The chemically treated dried fibrous web is mixed with process water to form a chemically treated pulp fiber slurry. The chemically treated pulp fiber slurry contains the fibers having the chemical additive secured thereto or retained thereby. A finished product having enhanced quality due to the retention of the chemical additive by the chemically treated pulp fibers may be produced from the chemically treated pulp fiber slurry.

Another aspect of the present invention resides in a method for making chemically treated paper products. The method comprising mixing pulp fibers with water to form a fiber slurry. The fiber slurry is formed into a wet fibrous web. This may be accomplished in a web-forming apparatus of a pulp sheet machine. The wet fibrous web may be dewatered to a predetermined consistency, thereby forming a dewatered fibrous web. A chemical additive is then applied to the dewatered fibrous web. The resulting chemically treated dewatered fibrous web contains chemically treated pulp fibers that have retained from between about 10 to about 100 percent of the applied amount of the chemical additive when the chemically treated pulp fibers are redispersed in water. The chemically treated pulp fibers, as a chemically treated dewatered fibrous web, may be transported or otherwise delivered to one or more paper machines. The chemically treated pulp fiber, as a chemically treated dewatered fibrous web, is mixed with process water to form a chemically treated pulp fiber slurry. The chemically treated pulp fiber slurry contains the chemically treated pulp fibers having the chemical additive secured thereto or retained thereby. A finished product having enhanced qualities due to the retention of the chemical additive by the chemically treated pulp fibers may be produced.

Another aspect of the present invention resides in a method for making chemically treated paper products. The method comprising mixing pulp fibers with water to form a fiber slurry. The fiber slurry is formed into a wet fibrous web. This may be accomplished in a web-forming apparatus of a pulp sheet machine. The wet fibrous web may be dewatered to a predetermined consistency, thereby forming a dewatered fibrous web. A chemical additive is then applied to the dewatered fibrous web, thereby forming a chemically treated dewatered fibrous web. The resulting chemically treated dewatered fibrous web contains chemically treated pulp fibers that have retained from between about 10 to about 100 percent of the applied amount of the chemical additive when the chemically treated pulp fibers are redispersed in water. The chemically treated dewatered fibrous web is dried to a predetermined consistency, thereby forming a chemically treated dried fibrous web. The resulting chemically treated dried fibrous web contains chemically treated pulp fibers that have retained from between about 10 to about 100 percent of the applied amount of the chemical additive when the chemically treated pulp fibers are redispersed in water. The chemically treated pulp fibers, as a chemically treated dried fibrous web, may be transported or otherwise delivered to one or more paper machines. The chemically treated pulp fiber, as a chemically treated dried fibrous web, is mixed with process water to form a chemically treated pulp fiber slurry. The chemically treated pulp fiber slurry contains the chemically treated pulp fibers having the chemical additive secured thereto or retained thereby. A finished product having enhanced qualities due to the retention of the chemical additive by the chemically treated pulp fibers may be produced.

Another aspect of the present invention resides in a method for making chemically treated paper products. The method comprising mixing pulp fibers with water to form a fiber slurry. The fiber slurry is formed into a wet fibrous web. This may be accomplished in a web-forming apparatus of a pulp sheet machine. The wet fibrous web may be dewatered to a predetermined consistency, thereby forming a dewatered fibrous web. The dewatered fibrous web is dried to a predetermined consistency, thereby forming a dried fibrous web. A chemical additive is then applied to the dried fibrous web. The resulting chemically treated dried fibrous web contains chemically treated pulp fibers that have retained from between about 10 to about 100 percent of the applied amount of the chemical additive when the chemically treated pulp fibers are redispersed in water. The chemically treated pulp fibers, as a chemically treated dried fibrous web, may be transported or otherwise delivered to one or more paper machines. The chemically treated pulp fiber, as a chemically treated dried fibrous web, is mixed with process water to form a chemically treated pulp fiber slurry. The chemically treated pulp fiber slurry containing the chemically treated pulp fibers having the chemical additive secured thereto or retained thereby. A finished product having enhanced qualities due to the retention of the chemical additive by the chemically treated pulp fibers may be produced.

Another aspect of the present invention resides in a method for making chemically treated finished paper or tissue products. The method comprising mixing pulp fibers with water to form a fiber slurry. The fiber slurry is formed into a wet fibrous web. This may be accomplished in a web-forming apparatus of a pulp sheet machine. The wet fibrous web may be dewatered to a predetermined consistency, thereby forming a dewatered fibrous web. A chemical additive is applied to the dewatered fibrous web, thereby forming a chemically treated dewatered fibrous web. In other embodiments, the dewatered fibrous web may be processed to a wet lap or processed to a crumb form before or after the application of the chemical additive. The resulting chemically treated pulp fiber contains chemically treated pulp fibers that have retained from between about 10 to about 100 percent of the applied amount of the chemical additive when the chemically treated pulp fibers are redispersed in water. The chemically treated dewatered fibrous web, once treated with the chemical additive, may be transported or otherwise delivered to one or more paper machines in the chemically treated form of a dewatered fibrous web, a dried fibrous web, a wet lap, or a crumb form. The chemically treated pulp fiber, as a wet fibrous web, a wet lap, or a crumb form, is mixed with process water to form a chemically treated pulp fiber slurry. The chemically treated pulp fiber slurry contains the chemically treated pulp fibers having the chemical additive secured thereto. A finished product having enhanced qualities due to the retention of the chemical additive by the chemically treated pulp fibers is produced.

Another aspect of the present invention resides in a method for making chemically treated finished paper or tissue products. The method comprising mixing pulp fibers with water to form a fiber slurry. The fiber slurry is formed into a wet fibrous web. This may be accomplished in a web-forming apparatus of a pulp sheet machine. The wet fibrous web may be dewatered to a predetermined consistency, thereby forming a dewatered fibrous web. A chemical additive is applied to the dewatered fibrous web, thereby forming a chemically treated dewatered fibrous web. In other embodiments, the dewatered fibrous web may be processed to a wet lap or processed to a crumb form before or after the application of the chemical additive. The resulting chemically treated pulp fiber contains chemically treated pulp fibers that have retained from between about 10 to about 100 percent of the applied amount of the chemical additive when the chemically treated pulp fibers are redispersed in water. The chemically treated dewatered fibrous web is dried to a predetermined consistency, thereby forming a chemically treated dried fibrous web. The resulting chemically treated dried fibrous web contains chemically treated pulp fibers that have retained from between about 10 to about 100 percent of the applied amount of the chemical additive when the chemically treated pulp fibers are redispersed in water. The dried fibrous web, once treated with the chemical additive, may be transported or otherwise delivered to one or more paper machines in the chemically treated form of a dried fibrous web. The chemically treated pulp fiber, as a chemically treated dried fibrous web, is mixed with process water to form a chemically treated pulp fiber slurry. The chemically treated pulp fiber slurry contains the chemically treated pulp fibers having the chemical additive secured thereto. A finished product having enhanced qualities due to the retention of the chemical additive by the chemically treated pulp fibers is produced.

Another aspect of the present invention resides in a method for making chemically treated finished paper or tissue products. The method comprising mixing pulp fibers with water to form a fiber slurry. The fiber slurry is formed into a wet fibrous web. This may be accomplished in a web-forming apparatus of a pulp sheet machine. The wet fibrous web is dewatered to a predetermined consistency, thereby forming a dewatered fibrous web. The dewatered fibrous web is dried to a predetermined consistency, thereby forming a dried fibrous web. A chemical additive is applied to the dried fibrous web, thereby forming a chemically treated dried fibrous web. In other embodiments, the dewatered fibrous web may be processed to a wet lap or processed to a crumb form before or after the application of the chemical additive. The resulting chemically treated pulp fiber contains chemically treated pulp fibers that have retained from between about 10 to about 100 percent of the applied amount of the chemical additive when the chemically treated pulp fibers are redispersed in water. The chemically treated dried fibrous web, once treated with the chemical additive, may be transported or otherwise delivered to one or more paper machines in the chemically treated form of a dried fibrous web, a dried fibrous web, a wet lap, or a crumb form. The chemically treated pulp fiber, as a wet fibrous web, a wet lap, or a crumb form, is mixed with process water to form a chemically treated pulp fiber slurry. The chemically treated pulp fiber slurry contains the chemically treated pulp fibers having the chemical additive secured thereto. A finished product having enhanced qualities due to the retention of the chemical additive by the chemically treated pulp fibers is produced.

Another aspect of the present invention resides in a method for making chemically treated paper products. The method comprises creating a fiber slurry comprising water and pulp fibers. The fiber slurry is formed into a wet fibrous web. This may be accomplished in a web-forming apparatus of a pulp sheet machine. The wet fibrous web may be dewatered to a predetermined consistency, thereby forming a dewatered fibrous web. In other embodiments, the pulp fiber may be processed to a wet lap or processed to a crumb form. A first chemical additive is applied to the dewatered fibrous web. At least a second chemical additive may be applied to the dewatered fibrous web, thereby forming a multi-chemically treated dewatered fibrous web. The second chemical additive may be added simultaneously with the first chemical additive or at different times or points of the pulp processing stage. The multi-chemically treated dewatered fibrous web, containing the first and second chemical additives, may be further dried to a predetermined consistency, thereby forming a chemically treated dried fibrous web. The resulting chemically treated dried fibrous web may have from about 10 to about 100 percent retention of the applied first and second chemical additives. The resulting chemically treated pulp fibers contains chemically treated pulp fibers that have retained from between about 10 to about 100 percent of the applied amount of at least each of the first and second chemical additives when the chemically treated pulp fibers are redispersed in water. The chemically treated pulp fibers, as a multi-chemically treated dried fibrous web or as a multi-chemically treated dewatered fibrous web, are transported or otherwise delivered to one or more paper machines. The chemically treated pulp fibers, as a chemically treated dried fibrous web or a chemically treated dewatered fibrous web, are mixed with process water to form a chemically treated pulp fiber slurry. The chemically treated pulp fiber slurry contains the chemically treated pulp fibers having the chemical additives secured thereto. A finished product having enhanced qualities due to the retention of the chemical additives by the chemically treated pulp fibers may be produced.

Another aspect of the present invention resides in a method for making chemically treated paper products. The method comprises creating a fiber slurry comprising water and pulp fibers. The fiber slurry is formed into a wet fibrous web. This may be accomplished in a web-forming apparatus of a pulp sheet machine. The wet fibrous web may be dewatered to a predetermined consistency, thereby forming a dewatered fibrous web. The dewatered fibrous web may be dried to a predetermined consistency, thereby forming a dried fibrous web. In other embodiments, the pulp fiber may be processed to a wet lap or processed to a crumb form. A first chemical additive is applied to the dried fibrous web. At least a second chemical additive may be applied to the dried fibrous web, thereby forming a multi-chemically treated dried fibrous web. The second chemical additives may be added simultaneously with the first chemical additives or at different times or points of the pulp processing. The resulting chemically treated dried fibrous web contains chemically treated pulp fibers that have retained from between about 10 to about 100 percent of the applied amount of at least each of the first and second chemical additives when the chemically treated pulp fibers are redispersed in water. The chemically treated pulp fibers, as a multi-chemically treated dried fibrous web, are transported or otherwise delivered to one or more paper machines. The chemically treated pulp fibers, as a chemically treated dried fibrous web, are mixed with process water to form a chemically treated pulp fiber slurry. The chemically treated pulp fiber slurry contains the chemically treated pulp fibers having the chemical additives secured thereto. A finished product having enhanced qualities due to the retention of the chemical additives by the chemically treated pulp fibers may be produced.

The present invention is particularly useful for adding chemical additives such as softening agents to the pulp fibers, allowing for the less problematic and lower cost production of finished products having enhanced qualities provided by the retained chemical additives by the pulp fibers.

Hence, another aspect of the present invention resides in paper products formed from pulp fibers that have been chemically treated to minimize the amount of residual, unretained chemical additives in the process water on a paper machine. The term "paper" is used herein to broadly include writing, printing, wrapping, sanitary, and industrial papers, newsprint, linerboard, tissue, bath tissue, facial tissue, napkins, wipers, wet wipes, towels, absorbent pads, intake webs in absorbent articles such as diapers, bed pads, meat and poultry pads, feminine care pads, and the like made in accordance with any conventional process for the production of such products. With regard to the use of the term "paper" as used herein includes any fibrous web containing cellulosic fibers alone or in combination with other fibers, natural or synthetic. It can be layered or unlayered, creped or uncreped, and can consist of a single ply or multiple plies. In addition, the paper or tissue web can contain reinforcing fibers for integrity and strength.

The term "softening agent" refers to any chemical additive that can be incorporated into paper products such as tissue to provide improved tactile feel and reduce paper stiffness. A softening agent may be selected from the group consisting of quaternary ammonium compounds, quaternized protein compounds, phospholipids, polysiloxane compounds, quaternized, hydrolyzed wheat protein/dimethicone phosphocopolyol copolymer, organoreactive polysilxanes, polyhydroxy compounds, and silicone glycols. These chemical additives can also act to reduce paper stiffness or can act solely to improve the surface characteristics of tissue, such as by reducing the coefficient of friction between the tissue surface and the hand.

The term "dye" refers to any chemical that can be incorporated into paper products, such as bathroom tissue, facial tissue, paper towels, and napkins, to impart a color. Depending on the nature of the chemical, dyes may be classified as acid dyes, basic dyes, direct dyes, cellulose reactive dyes, or pigments. All classifications are suitable for use in conjunction with the present invention.

The term "polyhydroxy compounds" refers to compounds selected from the group consisting of glycerol, sorbitols, polyglycerols having a weight average molecular weight of from about 150 to about 800, polyoxyethylene glycols and polyoxypropylene glycols having a weight average molecular weight from typically about 200 to about 10,000, more typically about 200 to about 4,000.

The term "water soluble" refers to solids or liquids that will form a solution in water, and the term "water dispersible" refers to solids or liquids of colloidal size or larger that can be dispersed into an aqueous medium.

The term "bonding agent" refers to any chemical that can be incorporated into tissue to increase or enhance the level of interfiber or intrafiber bonding in the sheet. The increased bonding can be either ionic, Hydrogen or covalent in nature. It is understood that a bonding agent refers to both dry and wet strength enhancing chemical additives.

The method for applying chemical additives to the pulp fibers may be used in a wide variety of pulp finishing processing, including dry lap pulp, wet lap pulp, crumb pulp, and flash dried pulp operations. By way of illustration, various pulp finishing processes (also referred to as pulp processing) are disclosed in *Pulp and Paper Manufacture The Pulping of Wood*, $2^{nd}$ Ed., Volume 1, Chapter 12. Ronald G. MacDonald, editor, which is incorporated by reference. Various methods may be used to apply the chemical additives in the present invention, including, but not limited to: spraying, coating, foaming, printing, size pressing, or any other method known in the art.

In addition, in situations where more than one chemical additive is to be employed, the chemical additives may be added to the fibrous web in sequence to reduce interactions between the chemical additives.

Many pulp fiber types may be used for the present invention including hardwood or softwoods, straw, flax, milkweed seed floss fibers, abaca, hemp, kenaf, bagasse, cotton, reed, and the like. All known papermaking fibers may be used, including bleached and unbleached fibers, fibers of natural origin (including wood fiber and other cellulose fibers, cellulose derivatives, and chemically stiffened or crosslinked fibers), some component portion of synthetic fiber (synthetic papermaking fibers include certain forms of fibers made from polypropylene, acrylic, aramids, acetates, and the like), virgin and recovered or recycled fibers, hardwood and softwood, and fibers that have been mechanically pulped (e.g., groundwood), chemically pulped (including but not limited to the kraft and sulfite pulp processings), thermomechanically pulped, chemithermomechanically pulped, and the like. Mixtures of any subset of the above mentioned or related fiber classes may be used. The pulp fibers can be prepared in a multiplicity of ways known to be advantageous in the art. Useful methods of preparing fibers include dispersion to impart curl and improved drying properties, such as disclosed in U.S. Pat. No. 5,348,620 issued Sep. 20, 1994 and U.S. Pat. No. 5,501,768 issued Mar. 26, 1996, both to M. A. Hermans et al. and U.S. Pat. No. 5,656,132 issued Aug. 12, 1997 to Farrington, Jr. et al.

According to the present invention, the chemical treatment of the pulp fibers may occur prior to, during, or after the drying phase of the pulp processing. The two generally accepted methods of drying include flash drying, can drying, flack drying, through air drying, I.R. drying, fluidized bed, or any method of drying known in the art. The present invention may also be applied to wet lap pulp processes without the use of dryers.

Numerous features and advantages of the present invention will appear from the following description. In the description, reference is made to the accompanying drawings which illustrate preferred embodiments of the invention. Such embodiments do not represent the full scope of the invention. Reference should therefore be made to the claims herein for interpreting the full scope of the invention.

DETAILED DESCRIPTION

The invention will now be described in greater detail with reference to the Figures. A variety of conventional pulping apparatuses and operations can be used with respect to the pulping phase, pulp processing, and drying of pulp fiber. It is understood that the pulp fibers could be virgin pulp fiber or recycled pulp fiber. Nevertheless, particular conventional components are illustrated for purposes of providing the context in which the various embodiments of the present invention can be used. Improved retention of chemical additives by the pulp fibers may be obtained by treating the pulp fibers according to the present invention rather than treating the pulp fibers in wet end additions at papermaking machines. In addition, the present invention allows for quick pulp fiber grade changes at the paper mills.

Figure 1:
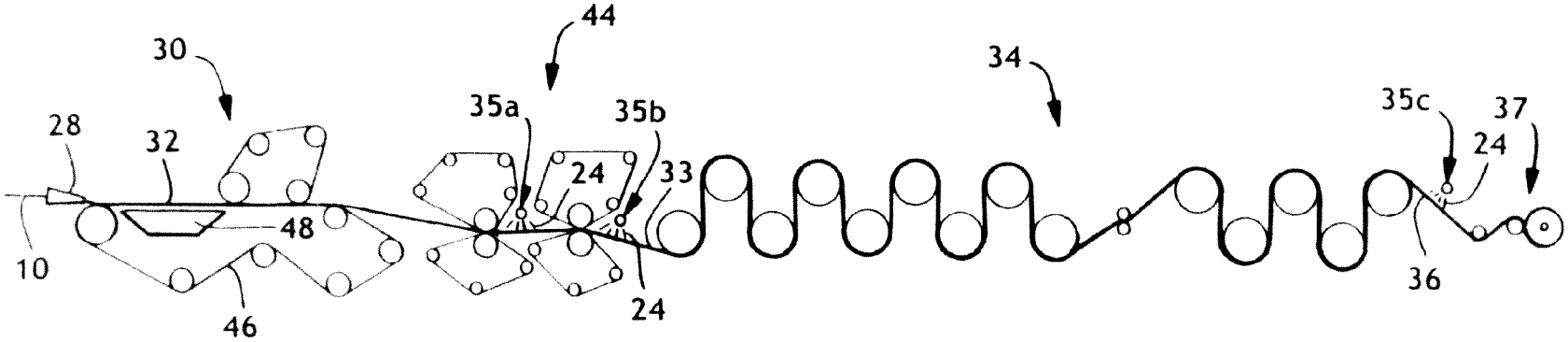
FIG. 1 depicts a schematic process flow diagram of a method according to the present invention for treating pulp fibers with chemical additives.

FIG. 1 depicts pulp processing preparation equipment used to apply chemical additives to pulp fibers according to one embodiment of the present invention. A fiber slurry 10 is prepared and thereafter transferred through suitable conduits (not shown) to the headbox 28 where the fiber slurry 10 is injected or deposited into a fourdrinier section 30 thereby forming a wet fibrous web 32. The wet fibrous web 32 may be subjected to mechanical pressure to remove process water. It is understood that the process water may contain process chemicals used in treating the fiber slurry 10 prior to a web formation step. In the illustrated embodiment, the fourdrinier section 30 precedes a press section 44, although alternative dewatering devices such as a nip thickening device, or the like may be used in a pulp sheet machine. The fiber slurry 10 is deposited onto a foraminous fabric 46 such that the fourdrinier section filtrate 48 is removed from the wet fibrous web 32. The fourdrinier section filtrate 48 comprises a portion of the process water. The press section 44 or other dewatering device known in the art suitably increases the fiber consistency of the wet fibrous web 32 to about 30 percent or greater, and particularly about 40 percent or greater thereby creating a dewatered web 33. The process water removed as fourdrinier section filtrate 48 during the web forming step may be used as dilution water for dilution stages in the pulp processing or discarded.

The dewatered fibrous web 33 may be further dewatered in additional press sections 44 or other dewatering devices known in the art. The suitably dewatered fibrous web 33 may be transferred to a dryer section 34 where evaporative drying is carried out on the dewatered fibrous web 33 to an airdry consistency, thereby forming a dried fibrous web 36. The dried fibrous web 36 is thereafter wound on a reel 37 or slit, cut into sheets, and baled via a baler 40 (see FIG. 2) for delivery to paper machines 38 (see FIG. 3).

Chemical additive 24 may be added or applied to the dewatered fibrous web 33 or the dried fibrous web 36 at a variety of addition points 35*a*, 35*b*, and 35*c* as shown in FIG. 1. It is understood that while only three addition points 35*a*, 35*b*, and 35*c* are shown in FIG. 1, the application of the chemical additive 24 may occur at any point between the point of initial dewatering of the wet fibrous web 32 to the point the dried fibrous web 36 is wound on the reel 37 or baled for transport to the paper machines 38. The addition point 35*a* shows the addition of the chemical additive 24 within press section 44. The addition point 35*b* shows the addition of the chemical additive 24 between the press section 44 and the dryer section 34. The addition point 35*c* shows the addition of the chemical additive 24 between the dryer section 34 and the reel 37 or baler 40.

A list of chemical additives that can be used in conjunction with the present invention include: dry strength agents, wet strength agents, softening agents, debonding agents, adsorbency agents, sizing agents, dyes, optical brighteners, chemical tracers, opacifiers, dryer adhesive chemicals, and the like. Additional chemical additives may include: pigments, emollients, humectants, viricides, bactericides, buffers, waxes, fluoropolymers, odor control materials and deodorants, zeolites, perfumes, vegetable and mineral oils, polysiloxane compounds, surfactants, moisturizers, UV blockers, antibiotic agents, lotions, fungicides, preservatives, aloe-vera extract, vitamin E, or the like. Suitable chemical additives are retained by the papermaking fibers and may or may not be water soluble or water dispersible.

At the paper machines 38, (see FIG. 3) the dried fibrous web 36 is mixed with water to form a chemically treated pulp fiber slurry 49. The chemically treated pulp fiber slurry 49 contains the chemically treated pulp fiber having the chemical additive 24 retained by the individual fibers. The chemically treated pulp fiber slurry 49 is passed through the paper machine 38 and processed to form a finished product 64. By way of illustration, various paper or tissue making processes are disclosed in U.S. Pat. No. 5,667,636 issued Sep. 16, 1997 to Engel et al.; U.S. Pat. No. 5,607,551 issued Mar. 4, 1997 to Farrington, Jr. et al.; U.S. Pat. No. 5,672,248 issued Sep. 30, 1997 to Wendt et al.; and, U.S. Pat. No. 5,494,554 issued Feb.

27, 1996 to Edwards et al., which are incorporated herein by reference. The finished product 64 has enhanced qualities due to the retention of the chemical additive 24 by the chemically treated pulp fibers during the pulp processing. In other embodiments of the present invention, additional chemical additive 24 may be added to the chemically treated pulp fiber slurry 49 during stock preparation at the paper machine 38.

Figure 2:
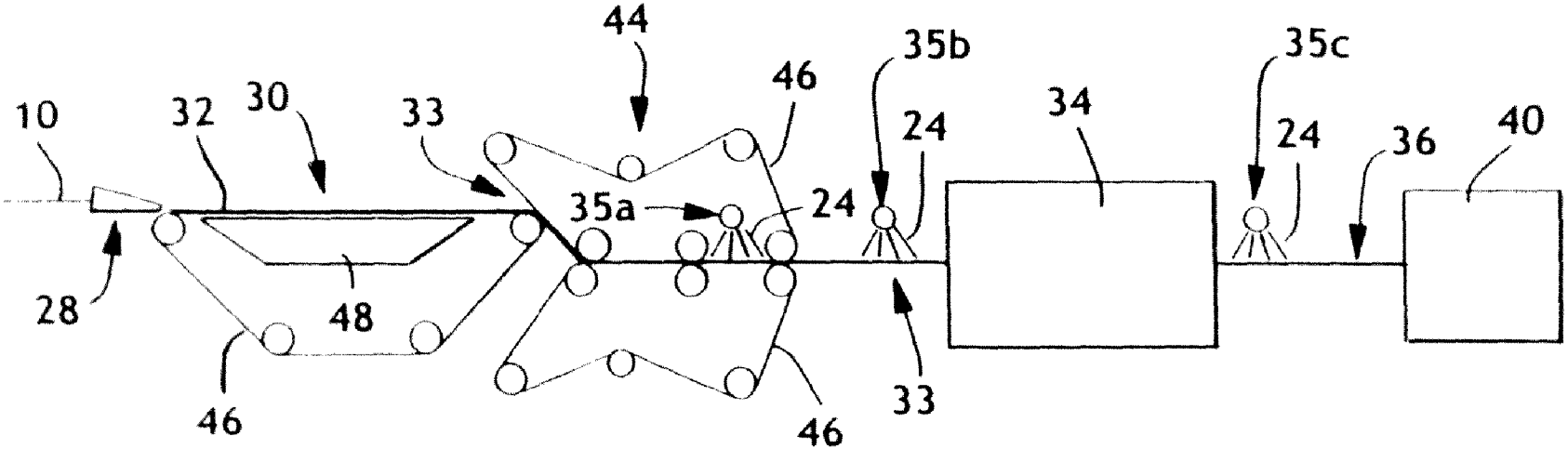
FIG. 2 depicts a schematic process flow diagram of a method according to the present invention for treating pulp fibers with chemical additives.

FIG. 2 depicts an alternative embodiment of the present invention using a different dry lap machine to prepare and treat the pulp. A fiber slurry 10 is prepared and thereafter transferred through suitable conduits (not shown) to the headbox 28 where the fiber slurry 10 is injected or deposited into a fourdrinier section 30 thereby forming a wet fibrous web 32. The wet fibrous web 32 may be subjected to mechanical pressure to remove process water. In the illustrated embodiment, the fourdrinier section 30 precedes a press section 44, although alternative dewatering devices such as a nip thickening device, or the like known in the art may be used in a pulp sheet machine. The fiber slurry 10 is deposited onto a foraminous fabric 46 such that the fourdrinier section filtrate 48 is removed from the wet fibrous web 32. The fourdrinier section filtrate 48 comprises a portion of the process water. The press section 44 or other dewatering device suitably increases the fiber consistency of the wet fibrous web 32 to about 30 percent or greater, and particularly about 40 percent or greater, thereby forming a dewatered fibrous web 33. The process water removed as fourdrinier section filtrate 48 during the web forming step may be used as dilution water for dilution stages in the pulp processing or discarded.

The dewatered fibrous web 33 may be further dewatered in additional press sections 44 or other dewatering devices known in the art. The suitably dewatered fibrous web 33 may be transferred to a dryer section 34 where evaporative drying is carried out on the dewatered fibrous web 33 to an airdry consistency, thereby forming a dried fibrous web 36. The dried fibrous web 36 is thereafter slit, cut into sheets, and baled via a baler 40 or wound on a reel 37 or wound onto a reel 37 (see FIG. 1) for delivery to paper machines 38 (see FIG. 3).

The chemical additive 24 may be added or applied to the dewatered fibrous web 33 or the dried fibrous web 36 at a variety of addition points 35*a*, 35*b*, and 35*c* as shown in FIG. 2. It is understood that while only three addition points 35*a*, 35*b*, and 35*c* are shown in FIG. 2, the application of the chemical additive 24 may occur at any point between the point of initial dewatering of the wet fibrous web 32 to the point the dried fibrous web 36 is wound on the reel 37 or baled for transport to the paper machines 38. The addition point 35*a* shows the addition of the chemical additive 24 within press section 44. The addition point 35*b* shows the addition of the chemical additive 24 between the press section 44 and the dryer section 34. The addition point 35*c* shows the addition of the chemical additive 24 between the dryer section 34 and the reel 37 or baler 40.

At the paper machines 38, (see FIG. 3) the dried fibrous web 36 is mixed with water to form a chemically treated pulp fiber slurry 49. The chemically treated pulp fiber slurry 49 contains the chemically treated pulp fiber having the chemical additive 24 retained by the individual fibers. The chemically treated pulp fiber slurry 49 is passed through the paper machine 38 and processed to form a finished product 64. By way of illustration, various paper or tissue making processes are disclosed in U.S. Pat. No. 5,667,636 issued Sep. 16, 1997 to Engel et al.; U.S. Pat. No. 5,607,551 issued Mar. 4, 1997 to Farrington, Jr. et al.; U.S. Pat. No. 5,672,248 issued Sep. 30, 1997 to Wendt et al.; and, U.S. Pat. No. 5,494,554 issued Feb. 27, 1996 to Edwards et al., which are incorporated herein by reference. The finished product 64 has enhanced qualities due to the retention of the chemical additive 24 by chemically treated the chemically treated pulp fibers during the pulp processing. In other embodiments of the present invention, additional chemical additive 24 may be added to the chemically treated pulp fiber slurry 49 during stock preparation at the paper machine 38.

Figure 4:
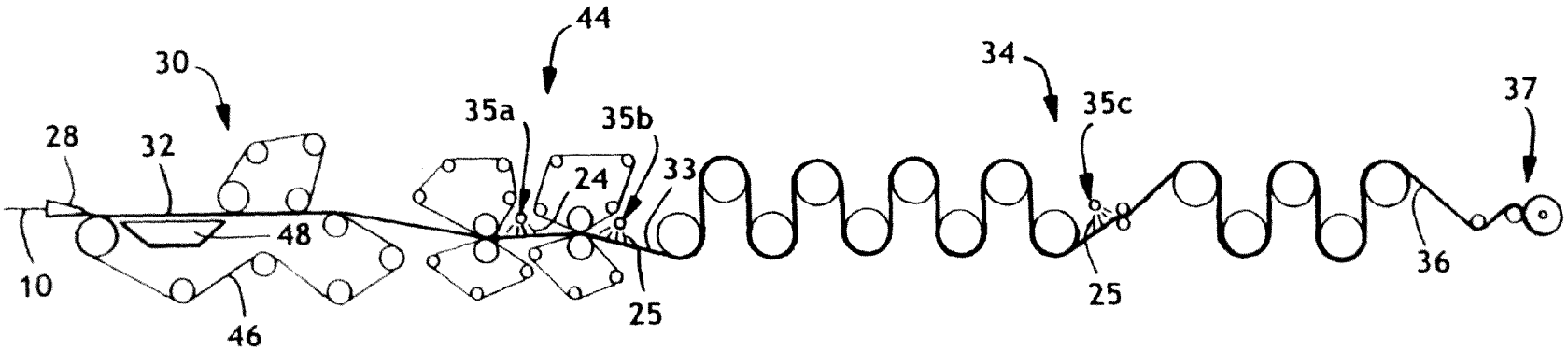
FIG. 4 depicts a schematic process flow diagram of a method according to the present invention for treating pulp fibers with multiple chemical additives.

FIG. 4 depicts an alternative embodiment of the present invention in which sequential addition of the first and second chemical additives 24 and 25, respectively, are added to the dewatered fibrous web slurry 33 and/or the dried fibrous web 36. It is understood that the addition of the first chemical additive 24 may occur anywhere that the second chemical additive 25 may be applied. It is also understood that the addition of the second chemical additive 25 may occur anywhere that the first chemical additive 24 may be applied. A fiber slurry 10 is prepared and thereafter transferred through suitable conduits (not shown) to the headbox 28 where the fiber slurry 10 is injected or deposited into a fourdrinier section 30 thereby forming a wet fibrous web 32. The wet fibrous web 32 may be subjected to mechanical pressure to remove process water. In the illustrated embodiment, the fourdrinier section 30 precedes a press section 44, although alternative dewatering devices such as a nip thickening device, or the like known in the art may be used. The fiber slurry 10 is deposited onto a foraminous fabric 46 such that the fourdrinier section filtrate 48 is removed from the wet fibrous web 32. The fourdrinier section filtrate 48 comprises a portion of the process water. The press section 44 or other dewatering device suitably increases the fiber consistency of the wet fibrous web 32 to about 30 percent or greater, and particularly about 40 percent or greater thereby forming a dewatered fibrous web 33. The process water removed as fourdrinier section filtrate 48 during the web forming step may be used as dilution water for dilution stages in the pulp processing or discarded.

The dewatered fibrous web 33 may be further dewatered in additional press sections 44 or other dewatering devices known in the art. The suitably dewatered fibrous web 33 may be transferred to a dryer section 34 where evaporative drying is carried out on the dewatered fibrous web 33 to an airdry consistency, thereby forming a dried fibrous web 36. The dried fibrous web 36 is thereafter wound on a reel 37 or slit, cut into sheets, and baled via a baler 40 (see FIG. 5) for delivery to paper machines 38 (see FIG. 3).

The first chemical additive 24 may be added or applied to the dewatered fibrous web 33 or the dried fibrous web 36 at a variety of addition points 35*a*, 35*b*, and 35*c* as shown in FIG. 4. It is understood that while only three addition points 35*a*, 35*b*, and 35*c* are shown in FIG. 4, the application of the first chemical additive 24 may occur at any point between the point of initial dewatering of the wet fibrous web 32 to the point the dried fibrous web 36 is wound on the reel 37 or baled for transport to the paper machines 38. The addition point 35*a* shows the addition of the first chemical additive 24 within press section 44. The addition point 35*b* shows the addition of the first chemical additive 24 between the press section 44 and the dryer section 34. The addition point 35*c* shows the addition of the first chemical additive 24 between the dryer section 34 and the reel 37 or baler 40.

The second chemical additive 25 may be added or applied to the dewatered fibrous web 33 or the dried fibrous web 36 at a variety of addition points 35*a*, 35*b*, and 35*c* as shown in FIG. 4. It is understood that while only three addition points 35*a*, 35*b*, and 35*c* are shown in FIG. 4, the application of the second chemical additive 25 may occur at any point between the point of initial dewatering of the wet fibrous web 32 to the point the dried fibrous web 36 is wound on the reel 37 or baled for transport to the paper machines 38 downstream of at least the initial point of application of the first chemical additive 24. The addition point 35*a* shows the addition of the second chemical additive 25 within press section 44. The addition point 35*b* shows the addition of the second chemical additive 25 between the press section 44 and the dryer section 34. The addition point 35*c* shows the addition of the second chemical additive 25 between the dryer section 34 and the reel 37 or baler 40.

At the paper machines 38, (see FIG. 3) the dried fibrous web 36 is mixed with water to form a chemically treated pulp fiber slurry 49. The chemically treated pulp fiber slurry 49 contains the chemically treated pulp fiber having the first and second chemical additives 24 and 25 retained by the individual fibers. The chemically treated pulp fiber slurry 49 is passed through the paper machine 38 and processed to form a finished product 64. By way of illustration, various paper or tissue making processes are disclosed in U.S. Pat. No. 5,667,636 issued Sep. 16, 1997 to Engel et al.; U.S. Pat. No. 5,607,551 issued Mar. 4, 1997 to Farrington, Jr. et al.; U.S. Pat. No. 5,672,248 issued Sep. 30, 1997 to Wendt et al.; and, U.S. Pat. No. 5,494,554 issued Feb. 27, 1996 to Edwards et al., which are incorporated herein by reference. The finished product 64 has enhanced qualities due to the retention of the first and second chemical additives 24 and 25 by the chemically treated pulp fibers during the pulp processing. In other embodiments of the present invention, additional chemical additives may be added to the chemically treated pulp fiber slurry 49 during stock preparation at the paper machine 38.

In other embodiments, it is understood that a third, fourth, fifth, so forth, chemical additives may be used to treat the dewatered fibrous web 33 and/or dried fibrous web 36.

Figure 5:
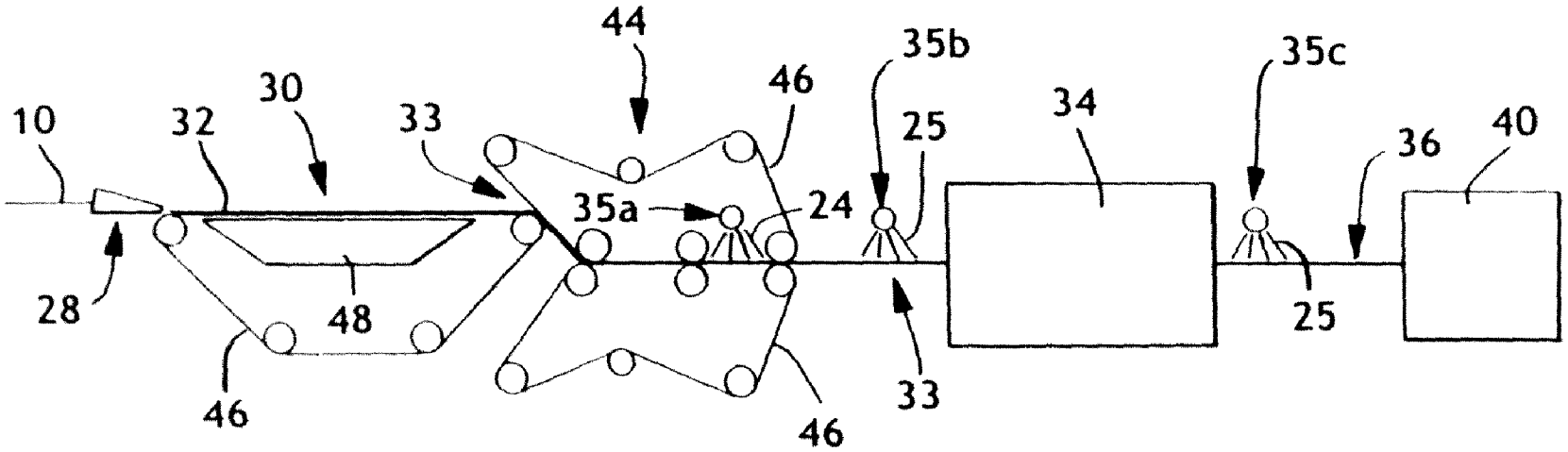
FIG. 5 depicts a schematic process flow diagram of a method according to the present invention for treating pulp fibers with multiple chemical additives.

FIG. 5 depicts an alternative embodiment of the present invention in which sequential addition of the first and second chemical additives 24 and 25, respectively, are added to the dewatered fibrous web slurry 33 and/or the dried fibrous web 36. It is understood that the addition of the first chemical additive 24 may occur anywhere that the second chemical additive 25 may be applied. It is also understood that the addition of the second chemical additive 25 may occur anywhere that the first chemical additive 24 may be applied. A fiber slurry 10 is prepared and thereafter transferred through suitable conduits (not shown) to the headbox 28 where the fiber slurry 10 is injected or deposited into a fourdrinier section 30 thereby forming a wet fibrous web 32. The wet fibrous web 32 may be subjected to mechanical pressure to remove process water. In the illustrated embodiment, the fourdrinier section 30 precedes a press section 44, although alternative dewatering devices such as a nip thickening device, or the like known in the art may be used. The fiber slurry 10 is deposited onto a foraminous fabric 46 such that the fourdrinier section filtrate 48 is removed from the wet fibrous web 32. The fourdrinier section filtrate 48 comprises a portion of the process water. The press section 44 or other dewatering device suitably increases the fiber consistency of the wet fibrous web 32 to about 30 percent or greater, and particularly about 40 percent or greater thereby forming a dewatered fibrous web 33. The process water removed as fourdrinier section filtrate 48 during the web forming step may be used as dilution water for dilution stages in the pulp processing or discarded.

The dewatered fibrous web 33 may be further dewatered in additional press sections 44 or other dewatering devices known in the art. The suitably dewatered fibrous web 33 may be transferred to a dryer section 34 where evaporative drying is carried out on the dewatered fibrous web 33 to an air dry consistency, thereby forming a dried fibrous web 36. The dried fibrous web 36 is thereafter slit, cut into sheets, and baled via a baler 40 or wound onto a reel 37 (see FIG. 4) for delivery to paper machines 38 (see FIG. 3).

The first chemical additive 24 may be added or applied to the dewatered fibrous web 33 or the dried fibrous web 36 at a variety of addition points 35*a*, 35*b*, and 35*c* as shown in FIG. 4. It is understood that while only three addition points 35*a*, 35*b*, and 35*c* are shown in FIG. 4, the application of the first chemical additive 24 may occur at any point between the point of initial dewatering of the wet fibrous web 32 to the point the dried fibrous web 36 is wound on the reel 37 or baled for transport to the paper machines 38. The addition point 35*a* shows the addition of the first chemical additive 24 within press section 44. The addition point 35*b* shows the addition of the first chemical additive 24 between the press section 44 and the dryer section 34. The addition point 35*c* shows the addition of the first chemical additive 24 between the dryer section 34 and the reel 37 or baler 40.

The second chemical additive 25 may be added or applied to the dewatered fibrous web 33 or the dried fibrous web 36 at a variety of addition points 35*a*, 35*b*, and 35*c* as shown in FIG. 5. It is understood that while only three addition points 35*a*, 35*b*, and 35*c* are shown in FIG. 5, the application of the second chemical additive 25 may occur at any point between the point of initial dewatering of the wet fibrous web 32 to the point the dried fibrous web 36 is wound on the reel 37 or baled for transport to the paper machines 38 downstream of at least the initial point of application of the first chemical additive 24. The addition point 35*a* shows the addition of the second chemical additive 25 within press section 44. The addition point 35*b* shows the addition of the second chemical additive 25 between the press section 44 and the dryer section 34. The addition point 35*c* shows the addition of the second chemical additive 25 between the dryer section 34 and the reel 37 or baler 40.

At the paper machines 38, (see FIG. 3) the dried fibrous web 36 is mixed with water to form a chemically treated pulp fiber slurry 49. The chemically treated pulp fiber slurry 49 contains the chemically treated pulp fiber having the first and second chemical additives 24 and 25 retained by the individual fibers. The chemically treated pulp fiber slurry 49 is passed through the paper machine 38 and processed to form a finished product 64. By way of illustration, various paper or tissue making processes are disclosed in U.S. Pat. No. 5,667,636 issued Sep. 16, 1997 to Engel et al.; U.S. Pat. No. 5,607,551 issued Mar. 4, 1997 to Farrington, Jr. et al.; U.S. Pat. No. 5,672,248 issued Sep. 30, 1997 to Wendt et al.; and, U.S. Pat. No. 5,494,554 issued Feb. 27, 1996 to Edwards et al., which are incorporated herein by reference. The finished product 64 has enhanced qualities due to the retention of the first and second chemical additives 24 and 25 by the chemically treated pulp fibers during the pulp processing. In other embodiments of the present invention, additional chemical additives may be added to the chemically treated pulp fiber slurry 49 during stock preparation at the paper machine 38.

In other embodiments, it is understood that a third, fourth, fifth, so forth, chemical additives may be used to treat the dewatered fibrous web 33 and/or dried fibrous web 36.

The amount of first chemical additive 24 is suitably about 0.1 kg./metric ton of pulp fiber or greater. In particular embodiments, wherein the first chemical additive 24 is a softening agent and is added in an amount from about 0.1 kg./metric ton of pulp fiber or greater.

The amount of the second chemical additive 25 is suitably about 0.1 kg./metric ton of pulp fiber or greater. In particular embodiments, wherein the second chemical additive 25 is a softening agent and is added in an amount from about 0.1 kg./metric ton of pulp fiber or greater.

In other embodiments of the present invention, each of the first and second chemical additives 24 and 25 may be added to the fiber slurry 10 at a variety of positions in the pulp processing apparatus.

In other embodiments of the present invention, one batch of pulp fibers may be treated with a first chemical additive 24 according to the method of the present invention as discussed above while a second batch of pulp fibers may be treated with a second chemical additive 25 according to the present invention. During the papermaking process, different pulp fibers or pulp fibers having different treatments may be processed into a layered paper or tissue product as disclosed in the U.S. Pat. No. 5,730,839 issued Mar. 24, 1998 to Wendt et al., which is incorporated herein by reference.

Figure 3:
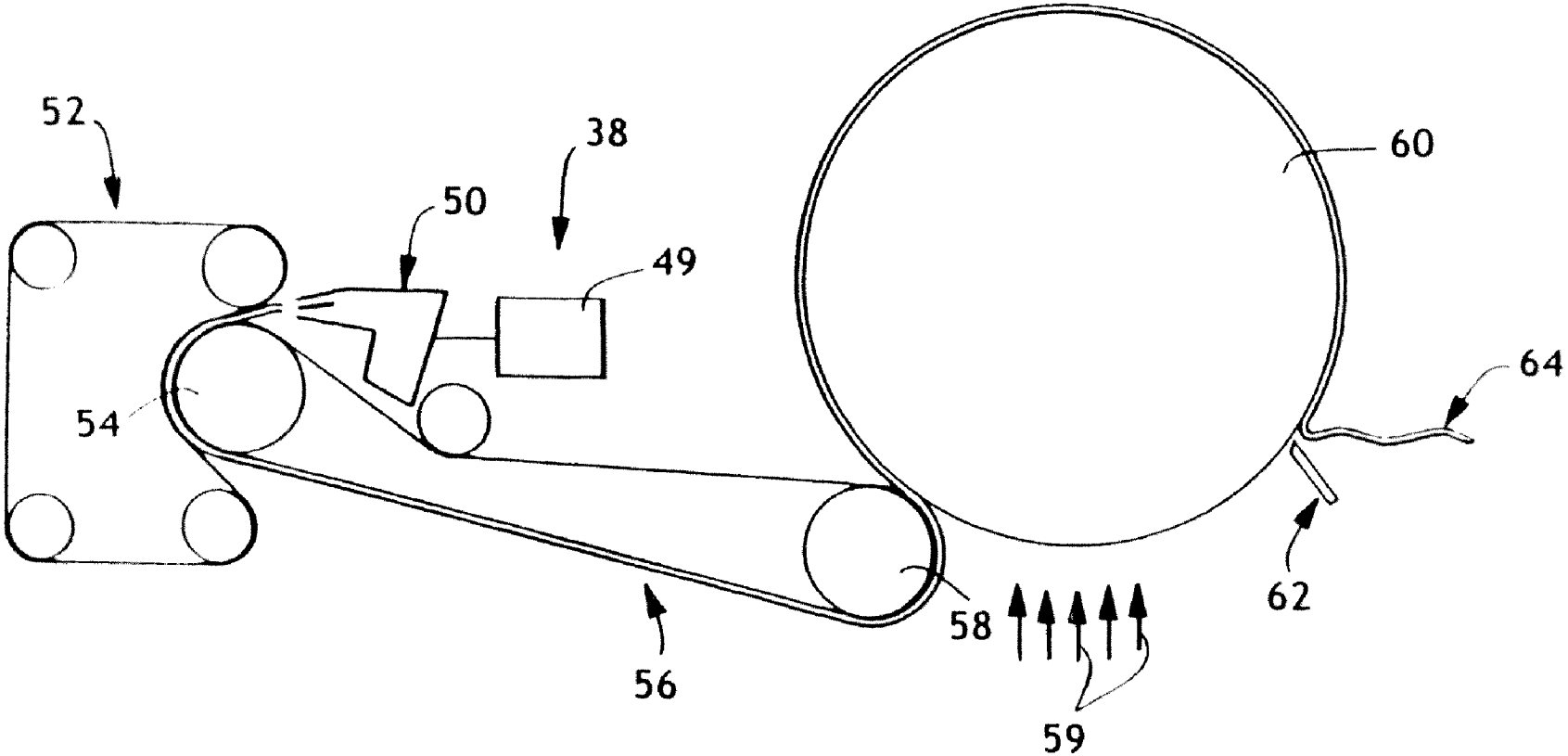
FIG. 3 depicts a schematic process flow diagram of a method of making a creped tissue sheet.

Referring to the FIG. 3, a tissue web 64 is formed using a 2-layer headbox 50 between a forming fabric 52 and a conventional wet press papermaking (or carrier) felt 56 which wraps at least partially about a forming roll 54 and a press roll 58. The tissue web 64 is then transferred from the papermaking felt 56 to the Yankee dryer 60 applying the vacuum press roll 58. An adhesive mixture is typically sprayed using a spray boom 59 onto the surface of the Yankee dryer 60 just before the application of the tissue web to the Yankee dryer 60 by the press roll 58. A natural gas heated hood (not shown) may partially surround the Yankee dryer 60, assisting in drying the tissue web 64. The tissue web 64 is removed from the Yankee dryer by the creping doctor blade 62. Two tissue webs 64 may be plied together and calendered. The resulting 2-ply tissue product can be wound onto a hard roll.

In other embodiments of the present invention, a gradient of the first and/or the second chemical additives 24 and 25 along the z-direction of the dewatered fibrous web 33 and/or the dried fibrous web 36 may be established by a directed application of the first and/or the second chemical additives 24 and 25. In one embodiment, the first and/or the second chemical additives 24 and 25 are applied to one side of the dewatered fibrous web 33 and/or the dried fibrous web 36. In another embodiment, one side of the dewatered fibrous web 33 and/or the dried fibrous web 36 is saturated with the first and/or the second chemical additives 24 and 25. In another embodiment, a dual gradient may be established in the z-direction of the dewatered fibrous web 33 and/or the dried fibrous web 36 by applying the first chemical additive 24 to one side of the dewatered fibrous web 33 and/or the dried fibrous web 36 and applying the second chemical additive 25 to the other (opposing) side of the dewatered fibrous web 33 and/or the dried fibrous web 36. The term "z-direction" refers to the direction through the thickness of the web material.

The first and/or the second chemical additives 24 and 25 may be applied so as to establish a gradient wherein about 100 percent of each of the first and/or the second chemical additives 24 and 25 is located from the side of the dewatered fibrous web 33 and/or the dried fibrous web 36 treated with the first and/or the second chemical additives 24 and 25 to the middle of the dewatered fibrous web 33 and/or the dried fibrous web 36 along the z-direction of the dewatered fibrous web 33 and/or the dried fibrous web 36 and substantially none of each of the first and/or the second chemical additives 24 and 25 is located from the middle of the dewatered fibrous web 33 and/or the dried fibrous web 36 to the opposing side of the dewatered fibrous web 33 and/or the dried fibrous web 36 along the z-direction of the dewatered fibrous web 33 and/or the dried fibrous web 36.

The first and/or the second chemical additives 24 and 25 may be applied so as to establish a gradient wherein about 66 percent of each of the first and/or the second chemical additives 24 and 25 is located from the side of the dewatered fibrous web 33 and/or the dried fibrous web 36 treated with the first and/or the second chemical additives 24 and 25 to the middle of the dewatered fibrous web 33 and/or the dried fibrous web 36 along the z-direction of the dewatered fibrous web 33 and/or the dried fibrous web 36 and about 33 percent of each of the first and/or the second chemical additives 24 and 25 is located from the middle of the dewatered fibrous web 33 and/or the dried fibrous web 36 to the opposing side of the dewatered fibrous web 33 and/or the dried fibrous web 36 along the z-direction of the dewatered fibrous web 33 and/or the dried fibrous web 36.

It is understood that in any of these embodiments, the first and second chemical additives 24 and 25 may be each applied an opposing side of the dewatered fibrous web 33 and/or the dried fibrous web 36. Alternatively, the first and second chemical additives 24 and 25 could be applied to both opposing sides of the dewatered fibrous web 33 and/or the dried fibrous web 36. In still another variation, the first and second chemical additives 24 and 25 could be applied to only one side of the dewatered fibrous web 33 and/or the dried fibrous web 36. Where only a first chemical additive 24 is applied to the dewatered fibrous web 33 and/or the dried fibrous web 36, the first chemical additive 24 may be applied to one side or both opposing sides of the dewatered fibrous web 33 and/or the dried fibrous web 36.

The first and/or the second chemical additives 24 and 25 may be applied so as to establish a gradient wherein about 60 percent of each of the first and/or the second chemical additives 24 and 25 is located from the side of the dewatered fibrous web 33 and/or the dried fibrous web 36 treated with the first and/or the second chemical additives 24 and 25 to the middle of the dewatered fibrous web 33 and/or the dried fibrous web 36 along the z-direction of the dewatered fibrous web 33 and/or the dried fibrous web 36 and about 40 percent of each of the first and/or the second chemical additives 24 and 25 is located from the middle of the dewatered fibrous web 33 and/or the dried fibrous web 36 to the opposing side of the dewatered fibrous web 33 and/or the dried fibrous web 36 along the z-direction of the dewatered fibrous web 33 and/or the dried fibrous web 36.

In another embodiment of the present invention, the amounts of the first and/or second chemical additives 24 and 25 may be reduced to impart unique product characteristics due to the distribution of the first and/or second chemical additives 24 and 25 of the dewatered fibrous web 33 and/or the dried fibrous web 36 as opposed to an embodiment of the present invention wherein an equilibrated distribution of the first and/or second chemical additives 24 and 25 of the dewatered fibrous web 33 and/or the dried fibrous web 36. The establishment of a gradient of the application of the first and/or the second chemical additives 24 and 25 of the dewatered fibrous web 33 and/or the dried fibrous web 36 is one way in which this may be accomplished. A directed application of a debonding chemical additive according to the present invention results in a reduced amount of the debonding chemical additive which produces a product having improved tensile strength as some of the pulp fiber is not treated by the debonding chemical additive.

EXAMPLES

The following example will describe how to produce chemically treated pulp as described according to the present invention. In these examples the definition of applied refers to the amount of chemical measured to be on the dry fiber mat after treatment. This amount is determined through measurement of chemical described in the Measurement Methods section.

Chemical retention in these examples is defined as the percentage of applied chemical treatment that remains with the fiber after the treated mat is redispersed to a low percent solids content in hot water. The percent retention was calculated according to Equation 1.

$$\% R = \frac{C_f - C_w / S\rho}{C_f}(100\%) \quad \text{Equation 1}$$

where % R is the chemical retention $C_f$ is the measured chemical level applied to pulp in units of kg/MT $C_W$ is the measured chemical level in the redispersed treated pulp water phase in units of mg/L S is the solids content of redispersed treated pulp in units of g fiber/g slurry ρ is the density of the pulp water slurry in units of g/L (typically 1000 g/L for dilute solutions)

Measurement Methods

Imidazoline concentrations were measured in water by using a DR/2010 Portable Datalogging Spectrophotometer commercially available from Hach Company, located in Loveland, Colo. The spectrophotometer method #401 for Quaternary Ammonium Compounds was employed using suitable blanks and dilution. Imidazoline concentrations were measured on fiber using a liquid extraction procedure consisting of oven-drying the pulp for 4 hours at 105° C.; weighing out 5 g of pulp and placing it in 100 mL of anhydrous methanol in a 125 mL container. The pulp-methanol was then placed in a Lab-line model 3590 orbital shaker bath, commercially available from Lab-line Instruments Melrose Park, Ill., which was operated at 300 rpm for 2 hours. An aliquot of the liquid sample absorbance was then measured at 238 nm on a Hewlett Packard model 8453 UV/VIS spectrophotometer, commercially available from Hewlett Packard Company, located in Palo Alto, Calif. This value was used with a prepared calibration curve using the identical procedure with imidazoline spiked samples.

Example 1

The untreated pulp in this example is a fully bleached eucalyptus pulp fiber slurry with a pH value of 4.5. Referencing FIG. 1, this fiber was formed into a mat a basis weight of approximately 600 grams per square meter, pressed and dried to 95 percent solids. Next, a 4 percent (active content basis) water dispersion of imidazoline softening agent (methyl-1-oleyl amidoethyl-2-oleyl imidazolinium methylsulfate identified as Mackernium DC-183, commercially available from McIntyre Ltd., located in University Park, Ill.), was sprayed on the surface of the fiber mat. The dispersion was created by mixing the imidazoline compound with water at approximately 120° F. for 10 minutes with a Lightnin Duramix mixer with an A100 axial flow impeller commercially available from Lightnin Mixers, located in Rochester, N.Y. The spray was applied using 7 mini-misting hollow cone nozzles with an 80 degree spray angle available from McMaster-Carr. The nozzles were place 5 inches center-to-center, 2.5 inches away from the sheet. The nozzles were aligned to spray perpendicular to the sheet applying single coverage. The nozzles were positioned approximately 5 feet after the dryer section. Each nozzle's output was adjusted approximately 40 milliliters per minute of the imidazoline-water dispersion by adjusting the dispersion feed pressure to 40 psig.

The amount of the chemical softener applied to the mat was approximately 3 kilograms per metric ton of eucalyptus fiber. The chemical softener was allowed to remain on the pulp mat for 2 weeks after which it was dispersed to approximately 1.6 percent solids with hot water at 120° F. Samples from this treatment were taken and used to determine the amount of chemical softener that remained in the water phase, which was drained as filtrate from the pulp fiber. The concentrations of the aqueous chemical softener levels were converted into a percent retention basis. The chemical softener retention level is shown in Table 1.

Example 2

Identical to Example 1 with the exception that the eucalyptus slurry pH was adjusted to a pH value of 7. The chemical softener retention level is shown in Table 1.

Example 3

The untreated pulp in this example is a fully bleached eucalyptus pulp fiber slurry with a pH value of 4.5. Referencing FIG. 1, this fiber was formed into a mat a basis weight of 900 grams oven-dry pulp per square meter, pressed and dried to 95 percent solids. Next, a 5 percent (active content basis) water dispersion of imidazoline softening agent (methyl-1-oleyl amidoethyl-2-oleyl imidazolinium methylsulfate identified as Mackernium DC-183, commercially available from McIntyre Ltd., located in University Park, Illinois), was sprayed onto the surface of the fiber mat. The dispersion was created by mixing the imidazoline compound with water at approximately 120° F. for 10 minutes with a Lightnin Duramix mixer with an A100 axial flow impeller commercially available from Lightnin Mixers, located in Rochester, N.Y. The spray was applied using 15 mini-misting hollow cone nozzles with an 80 degree spray angle available from McMaster-Carr. The nozzles were place 2.5 inches center-to-center, 1.5 inches away from the sheet. The nozzles were aligned to spray perpendicular to the sheet applying single coverage. The nozzles were positioned approximately 5 feet after the dryer section. Each nozzle's output was adjusted to approximately 55 milliliters per minute of the imidazoline-water dispersion by adjusting the dispersion feed pressure to 60 psig.

The amount of the chemical softener applied to the mat was approximately 7.5 kilograms per metric ton of eucalyptus fiber. The chemical softener was allowed to remain on the pulp mat for 2 weeks after which it was dispersed to approximately 1.6 percent solids with hot water at 120° F. Samples from this treatment were taken and used to determine the amount of chemical softener that remained in the water phase, which was drained as filtrate from the pulp fiber. The concentrations of the aqueous chemical softener levels were converted into a percent retention basis. The aqueous chemical softener retention level is shown in Table 1.

Example 4

The untreated pulp in this example is a fully bleached eucalyptus pulp fiber slurry with a pH value of 4.5. Referencing FIG. 1, this fiber was formed into a mat at a basis weight of 600 grams per square meter, and pressed to 45% solids after which a 4 percent dispersion of an imidazoline softening agent (methyl-1-oleyl amidoethyl-2-oleyl imidazolinium methylsulfate identified as Mackernium DC-183), was sprayed onto the surface of the fiber mat. The nozzles were positioned approximately 1 foot prior to the second press. Chemical softener was applied at approximately 1.5 kg/MT in this manner after which the pulp sheet was dried to approximately 95 percent solids.

The chemical softener was allowed to remain on the pulp mat for 2 weeks after which it was dispersed to approximately 1.6 percent solids with hot water at 120° F. Samples from this treatment were taken and used to determine the amount of chemical softener that remained in the water phase, which was drained as filtrate from the pulp fiber. The concentrations of the aqueous chemical softener levels were then converted into a percent retention basis. The chemical softener retention level is shown in Table 1.

Example 5

Identical to Example 4 with the exception that the eucalyptus slurry was adjusted to a pH value of 7.0. The aqueous chemical softener retention level is shown in Table 1.

Example 6

The untreated pulp in this example is a fully bleached eucalyptus pulp fiber slurry with a pH value of 4.5. Referencing FIG. 1, this fiber was formed into a mat at a basis weight of 900 grams per square meter, and pressed to 60% solids after which a 4 percent dispersion of an imidazoline softening agent (methyl-1-oleyl amidoethyl-2-oleyl imidazolinium methylsulfate identified as Mackernium DC-183), was sprayed onto the surface of the fiber mat. The nozzles were positioned approximately 3 feet before the dryer section. Chemical softener was applied at approximately 7.5 kg/MT in this manner after which the pulp sheet was dried to 95 percent solids.

The chemical softener was allowed to remain on the pulp mat for 2 weeks after which it was dispersed to approximately 1.6 percent solids with hot water at 120° F. Samples from this treatment were taken and used to determine the amount of chemical softener that remained in the water phase, which was drained as filtrate from the pulp fiber. The concentrations of the aqueous chemical softener levels were then converted into a percent retention basis. The aqueous chemical softener retention level is shown in Table 1.

Example 7

The untreated pulp in this example is a fully bleached eucalyptus pulp fiber slurry with a pH value of 4.5. Referencing FIG. 2, this fiber was formed into a mat a basis weight of approximately 1000 grams per square meter, pressed and dried to 90 percent solids, after which a 4 percent dispersion of an imidazoline softening agent (methyl-1-oleyl amidoethyl-2-oleyl imidazolinium methylsulfate identified as Mackernium DC-183), was sprayed on the surface of the fiber mat. The spray was applied using 21 Veejet HVV 11004 nozzles with a 110 degree spray angle available from Spraying Systems, located in Wheaton, Ill. The nozzles were place 8.1 inches center-to-center, 1.5 inches away from the sheet. The nozzles were aligned to spray perpendicular to the sheet applying single coverage. The nozzles were positioned approximately 10 feet after the dryer section. Each nozzle's output was adjusted to approximately 500 milliliters per minute of the imidazoline-water dispersion by adjusting the dispersion feed pressure to 35 psig. The fiber mat's velocity was approximately 500 meters per minute during the application.

The amount of the chemical softener applied to the mat was approximately 2 kilograms per metric ton of eucalyptus fiber. The chemical softener was allowed to remain on the pulp mat for 3 weeks after which it was dispersed to approximately 8.5 percent solids with hot water at 120° F. Samples from this treatment were taken and used to determine the amount of chemical softener that remained in the water phase, which was drained as filtrate from the pulp fiber. The concentrations of the aqueous chemical softener levels were converted into a percent retention basis. The chemical softener retention level is shown in Table 1.

Example 8

Identical to Example 7 with the exceptions that the eucalyptus slurry pH was adjusted to a pH value of 7, the chemical softening agent was applied at a 1.5 kg/MT level, and the pulp was redispersed at 2.5 percent solids. The chemical softener retention level is shown in Table 1.

TABLE 1

Aqueous Chemical Softener Levels

| Sample | Chemical Softener | Application location | Pre-treated pulp pH | Chemical Softener Application Level (kg/MT fiber) | Chemical Softener Retention (%) |
|---|---|---|---|---|---|
| Example 1 | Imidazoline Emulsion | Post-dryer | 4.5 | 3.2 | 87.9% |
| Example 2 | Imidazoline Emulsion | Post-dryer | 7.0 | 3.2 | 87.8% |
| Example 3 | Imidazoline Emulsion | Post-dryer | 4.5 | 7.4 | 78.8% |
| Example 4 | Imidazoline Emulsion | Press-section | 4.5 | 1.5 | 91.2% |
| Example 5 | Imidazoline Emulsion | Press-section | 7.0 | 1.5 | 91.6% |
| Example 6 | Imidazoline Emulsion | Pre-dryer | 4.5 | 7.4 | 86.0% |
| Example 7 | Imidazoline Emulsion | Post-dryer | 4.5 | 1.9 | 99.5% |
| Example 8 | Imidazoline Emulsion | Post-dryer | 7.0 | 1.6 | 87.3% |

Example 9

The chemically treated eucalyptus pulp in Example 1 was used to produce a layered soft tissue product. The tissue product was made using the overall process shown in FIG. 3. The first stock layer contained the chemically treated Eucalyptus hardwood pulp fiber, which made up about 65 percent of the tissue web by weight. This first stock layer was the first layer to come into contact with the forming fabric and was also the layer that came into contact with the drying surface of the Yankee dryer. The second stock layer contained northern softwood kraft pulp fiber. The second stock layer made up about 35 percent of the tissue web by weight. The two layers were pressed together at an approximately 15% solids vacuumed, pressed, and dried with a Yankee Dryer.

A modified polyacrylamide dry strength agent, Parez 631 NC commercially available from Cytec Industries Inc. located in West Paterson, N.J., was added to the pulp fiber of the softwood layer. The Parez 631 NC was added to the thick stock at an addition level of about 0.2% of the pulp fiber in the entire tissue web. A polyamide epichlorohydrin wet strength agent, Kymene 557LX commercially available from the Hercules, Inc., located in Wilmington, Del., was added to both the Eucalyptus and northern softwood kraft furnishes at an addition level of about 0.2% based on the pulp fiber in the entire tissue web. The basis weight of the tissue web was about 7.0 pounds per 2880 square feet of oven dried tissue web.

Referring to the FIG. 3, the tissue web was formed using 2 separate headboxes with a 94M forming fabric commercially available from Albany International, located in Albany, N.Y., and a conventional wet press papermaking (or carrier) felt (Duramesh commercially available from Albany International, located in Albany, N.Y.) which wraps at least partially about a forming roll and a press roll. The basis weight of the tissue web was about 7.0 pounds per 2880 square feet of oven dried tissue web.

The tissue web was then transferred from the papermaking felt to the Yankee dryer by the press roll. The water content of the tissue web on the papermaking felt just prior to transfer of the tissue web to the Yankee dryer was about 80 percent. The moisture content of the tissue web after the application of the press roll was about 55 percent. An adhesive mixture was sprayed using a spray boom onto the surface of the Yankee dryer just before the application of the tissue web by the press roll. The adhesive mixture consisted of about 40% polyvinyl alcohol, about 40% polyamide resin and about 20% quaternized polyamido amine as disclosed in U.S. Pat. No. 5,730,839 issued to Wendt et al. which is herein incorporated by reference. The application rate of the adhesive mixture was about 6 pounds of dry adhesive per metric ton of dry pulp fiber in the tissue web. A natural gas heated hood partially surrounding the Yankee dryer had a supply air temperature of about 680° F. to assist in drying the tissue web. The temperature of the tissue web after the application of the creping doctor was about 225° F. as measured with a handheld infrared temperature gun. The machine speed of the X inch wide tissue web was about 50 feet per minute. The crepe blade had a 10 degree bevel and was loaded with a ¾ inch extension. The crepe ratio was about 1.30 or about 30%.

Example 10

Identical to Example 9 with the exception that chemically treated eucalyptus pulp in Example 2 was used to produce a layered soft tissue product.

Example 11

Identical to Example 10 with the exception that chemically treated eucalyptus pulp in Example 3 was used to produce a layered soft tissue product.

Example 12

Identical to Example 11 with the exception that chemically treated eucalyptus pulp in Example 4 was used to produce a layered soft tissue product.

Example 13

Identical to Example 12 with the exception that chemically treated eucalyptus pulp in Example 5 was used to produce a layered soft tissue product.

Example 14

Identical to Example 13 with the exception that chemically treated eucalyptus pulp in Example 6 was used to produce a layered soft tissue product.

Example 15

The chemically treated eucalyptus pulp in Example 7 was used to produce a layered soft tissue product. The tissue product was made using the overall process shown in FIG. 3. The first stock layer contained the chemically treated Eucalyptus hardwood pulp fiber, which made up about 65 percent of the tissue web by weight. This first stock layer was the first layer to come into contact with the forming fabric and was also the layer that came into contact with the drying surface of the Yankee dryer. The second stock layer contained northern softwood kraft pulp fiber. The second stock layer made up about 35 percent of the tissue web by weight. A polyamide epichlorohydrin wet strength agent, Kymene 557LX commercially available from the Hercules, Inc., was added to both the Eucalyptus and northern softwood kraft furnishes at an addition level of about 0.2% based on the pulp fiber in the entire tissue web. The basis weight of the tissue web was approximately 7.0 pounds per 2880 square feet of oven dried tissue web.

Referring to the FIG. 3 the tissue web was formed using a 2-layer headbox between an Albany P-621 forming fabric commercially available from Albany International Corp., located in Menasha, Wis., and a conventional wet press papermaking (or carrier) felt (Weavex M1C commercially available from Weavex located in Wake Forest, N.C.) which wraps at least partially about a forming roll and a press roll. The basis weight of the tissue web was about 7.0 pounds per 2880 square feet of oven dried tissue web.

The tissue web was then transferred from the papermaking felt to the Yankee dryer by the vacuum press roll. The water content of the tissue web on the papermaking felt just prior to transfer of the tissue web to the Yankee dryer was about 87 percent. The moisture content of the tissue web after the application of the press roll was about 55 percent. An adhesive mixture was sprayed using a spray boom onto the surface of the Yankee dryer just before the application of the tissue web by the press roll. The adhesive mixture consisted of about 40% polyvinyl alcohol, about 40% polyamide resin and about 20% quaternized polyamido amine as disclosed in U.S. Pat. No. 5,730,839 issued to Wendt et al. which is herein incorporated by reference. The application rate of the adhesive mixture was about 5.5 pounds of dry adhesive per tonne of dry pulp fiber in the tissue web. A natural gas heated hood (not shown) partially surrounding the Yankee dryer had a supply air temperature of about 680° F. to assist in drying the tissue web. The temperature of the tissue web after the application of the creping doctor was about 240° F. as measured with a handheld infrared temperature gun. The machine speed of the 24 inch wide tissue web was about 3000 feet per minute. The crepe ratio was about 1.30 or about 30%.

Two tissue webs were unwound from two soft rolls (or parent rolls) and plied together and calendered with two steel rolls at 80 pounds per lineal inch. The 2-ply tissue product was constructed such that the first stock layer containing the chemically treated Eucalyptus pulp fiber was plied to the outside of the 2-ply tissue product, which was wound onto a hard roll. The hard roll is converted into finished product, such as facial tissue and the like. The finished basis weight of the 2-ply tissue product at standard TAPPI standard temperature and humidity was about 17 pounds per 2880 square feet. The MD tensile was about 1100 grams per 3 inches and the CD tensile was about 500 grams per 3 inches. The thickness of one 2-ply tissue product was about 0.2 millimeters. The MD stretch in the finished tissue product was about 18 percent. All 2-ply tissue tests were conducted in an environmentally controlled room with 50% relative humidity and a temperature of 73° F.

Example 16

Identical to Example 15 with the exception that chemically treated eucalyptus pulp in Example 8 was used to produce a layered soft tissue product.

While the invention has been described in conjunction with specific embodiments, it is to be understood that many alternatives, modifications and variations will be apparent to those skilled in the art in light of the foregoing description. Accordingly, this invention is intended to embrace all such alternatives, modifications and variations which fall within the spirit and scope of the appended claims.

We claim:

1. A method for applying a chemical additive to pulp fiber, said method comprising:

a) creating a fiber slurry comprising process water and pulp fibers;

b) transporting said fiber slurry to a web-forming apparatus of a pulp sheet machine and forming a wet fibrous web;

c) dewatering said wet fibrous web to a predetermined consistency thereby forming a dewatered fibrous web;

d) applying a first chemical additive to said dewatered fibrous web thereby forming a chemically treated dewatered fibrous web of chemically treated pulp fibers;

e) applying a second chemical additive to said chemically treated dewatered fibrous web;

f) drying said chemically treated dewatered fibrous web to a predetermined consistency thereby forming a chemically treated dried fibrous; and g) dispersing the chemically treated pulp fibers of the chemically treated dried fibrous web in water and draining the water from the chemically treated pulp fibers, wherein said chemically treated pulp fibers retain from between about 10 to about 100 percent of the applied amount of said first and second chemical additives.

2. The method of claim 1, further comprising transporting said chemically treated dried fibrous web to a paper machine and mixing said chemically treated dried fibrous web with water to form a chemically treated pulp fiber slurry, wherein said chemically treated pulp fiber slurry contains chemically treated pulp fibers having said first and second chemical additive retained thereby.

3. The method of claim 1, wherein said chemically treated dewatered fibrous web includes a z-direction gradient of said first chemical additive.

4. The method of claim 1, wherein said chemically treated dewatered fibrous web includes a z-direction gradient of said second chemical additive.

5. The method of claim 1, wherein said first chemical additive is selected from the group comprising softening agents, dry strength agents, wet strength agents, opacifying agents, dyes, debonding agents, absorbency agents, sizing agents, optical brighteners, chemical tracers, and mixtures thereof.

6. The method of claim 5, wherein said first chemical additive is a softening agent selected from the group consisting of quaternary ammonium compounds, quaternized protein compounds, phospholipids, silicone quaternaries, quaternized, hydrolyzed wheat protein/dimethicone phosphocopolyol copolymer, organoreactive polysiloxanes, polyhydroxy compounds, and silicone gylcols.

7. The method of claim 1 wherein said second chemical additive is selected from the group comprising softening agents, dry strength agents, wet strength agents, opacifying agents, dyes, debonding agents, absorbency agents, sizing agents, optical brighteners, chemical tracers, and mixtures thereof.

8. The method of claim 7, wherein said second chemical additive is a softening agent selected from the group consisting of quaternary ammonium compounds, quaternized protein compounds, phospholipids, silicone quaternaries, quaternized, hydrolyzed wheat protein/dimethicone phosphocopolyol copolymer, organoreactive polysiloxanes, polyhydroxy compounds, and silicone gylcols.

9. The method of claim 1, wherein said first and second chemical additives are applied to said dewatered fibrous web simultaneously.

10. The method of claim 1, wherein said first chemical additive is applied to said dewatered fibrous web in an amount of about 0.1 kilograms per metric ton or greater.

11. The method of claim 1, wherein said second chemical additive is applied to said dewatered fibrous web in an amount of about 0.1 kilogram per metric ton or greater.

12. The method of claim 1, wherein said chemically treated dried fibrous web has a consistency ranging from about 65 percent to about 100 percent.

13. The method of claim 1, wherein said chemically treated dried fibrous web has a consistency ranging from about 85 percent to about 95 percent.

14. The method of claim 1, wherein sufficient residence time is provided after said first chemical additive is applied to said dewatered fibrous web to allow said first chemical additive to be retained by said chemically treated pulp fiber.

15. The method of claim 1, wherein sufficient residence time is provided after said second chemical additive is applied to said dewatered fibrous web to allow said second chemical additive to be retained by said chemically treated pulp fiber.

16. A method for applying chemical additives to pulp fiber, said method comprising:

a) mixing pulp fibers with process water to form a fiber slurry;

b) transporting said fiber slurry to a web-forming apparatus of a pulp sheet machine and forming a wet fibrous web;

c) dewatering said wet fibrous web to a predetermined consistency thereby forming a dewatered fibrous web;

d) applying a first chemical additive to said dewatered fibrous web thereby forming a chemically treated dewatered fibrous web;

e) drying said chemically treated dewatered fibrous web to a predetermined consistency thereby forming a dried fibrous web;

f) applying a second chemical additive to said dried fibrous web thereby forming a chemically treated dried fibrous web containing chemically treated pulp fibers; and g) dispersing the chemically treated pulp fibers of the chemically treated dried fibrous web in water and draining the water from the chemically treated pulp fibers, wherein said chemically treated pulp fibers retain from between about 10 to about 100 percent of the applied amount of said first and second chemical additives.

17. The method of claim 16, wherein said chemically treated dewatered fibrous web includes a z-direction gradient of said first chemical additive.

18. The method of claim 16, wherein said chemically treated dried fibrous web includes a z-direction gradient of said first chemical additive.

19. The method of claim 16, further comprising transporting said chemically treated dried fibrous web to a paper machine and mixing said chemically treated dried fibrous web with water to form a chemically treated pulp fiber slurry, said chemically treated pulp fiber slurry containing chemically treated pulp fibers having at least said first and second chemical additives retained thereby.

20. The method of claim 19, wherein the amount of said first chemical additive retained by said chemically treated pulp fibers of said chemically treated dried fibrous web is about 0.1 kilogram per metric ton or greater, and the amount of unretained said first chemical additive in said water is between 0 and about 90 percent of the applied amount of said first chemical additive when said chemically treated pulp fibers are redispersed in water.

21. The method of claim 19, wherein the amount of said second chemical additive retained by said chemically treated pulp fibers is about 0.1 kilogram per metric ton or greater, and the amount of unretained said second chemical additive in said water is between 0 and about 90 percent of the applied amount of said second chemical additive when said chemically treated pulp fibers are redispersed in water.

22. The method of claim 19, wherein the amount of said first chemical additive retained by said chemically treated pulp fibers is about 0.1 kilograms per metric ton 15 or greater, and the amount of unretained said first chemical additive in said water is between 0 and about 90 percent of the applied amount of said first chemical additive when said chemically treated pulp fibers are redispersed in water and wherein the amount of said second chemical additive retained by said chemically treated pulp fibers is about 0.1 kilogram per metric ton or greater, and the amount of unretained said second chemical additive in said water is between 0 and about 90 percent of the applied amount of said second chemical additive when said chemically treated pulp fibers are redispersed in water.

* * * * *